US008295443B2

(12) United States Patent
Al-Sadah

(10) Patent No.: US 8,295,443 B2
(45) Date of Patent: Oct. 23, 2012

(54) X-RAY SYSTEM WITH SUPERCONDUCTING ANODE

(75) Inventor: Jihad H. Al-Sadah, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 114 days.

(21) Appl. No.: 12/805,012

(22) Filed: Jul. 7, 2010

(65) Prior Publication Data

US 2012/0008749 A1 Jan. 12, 2012

(51) Int. Cl.
*H01J 35/08* (2006.01)

(52) U.S. Cl. ..... 378/143; 378/119

(58) Field of Classification Search ..... 378/130, 378/141, 119, 143

See application file for complete search history.

(56) References Cited

U.S. PATENT DOCUMENTS

| | | | | |
|---|---|---|---|---|
| 4,414,487 | A | 11/1983 | Yamashita et al. | |
| 4,486,659 | A | 12/1984 | Turner | |
| 4,577,340 | A | 3/1986 | Carlson et al. | |
| 4,713,833 | A | 12/1987 | Turner et al. | |
| 7,391,850 | B2 | 6/2008 | Kaertner et al. | |
| 7,589,323 | B2 | 9/2009 | Tanaka et al. | |
| 2005/0025285 | A1 * | 2/2005 | Kindlein | 378/141 |
| 2006/0251217 | A1 | 11/2006 | Kaertner et al. | |
| 2009/0252297 | A1 | 10/2009 | Lewis | |

* cited by examiner

*Primary Examiner* — Hoon Song
(74) *Attorney, Agent, or Firm* — Richard C. Litman

(57) ABSTRACT

The x-ray system with a superconducting anode includes an anode of x-ray machine made from a material capable of superconductivity, which is then cooled to be in superconducting state while being bombarded by an electron beam to generate x-rays. If a non-superconducting heat island is formed, then a magnetic field is used to penetrate this region and spread the heat in the form of hot electrons over the target material.

2 Claims, 1 Drawing Sheet

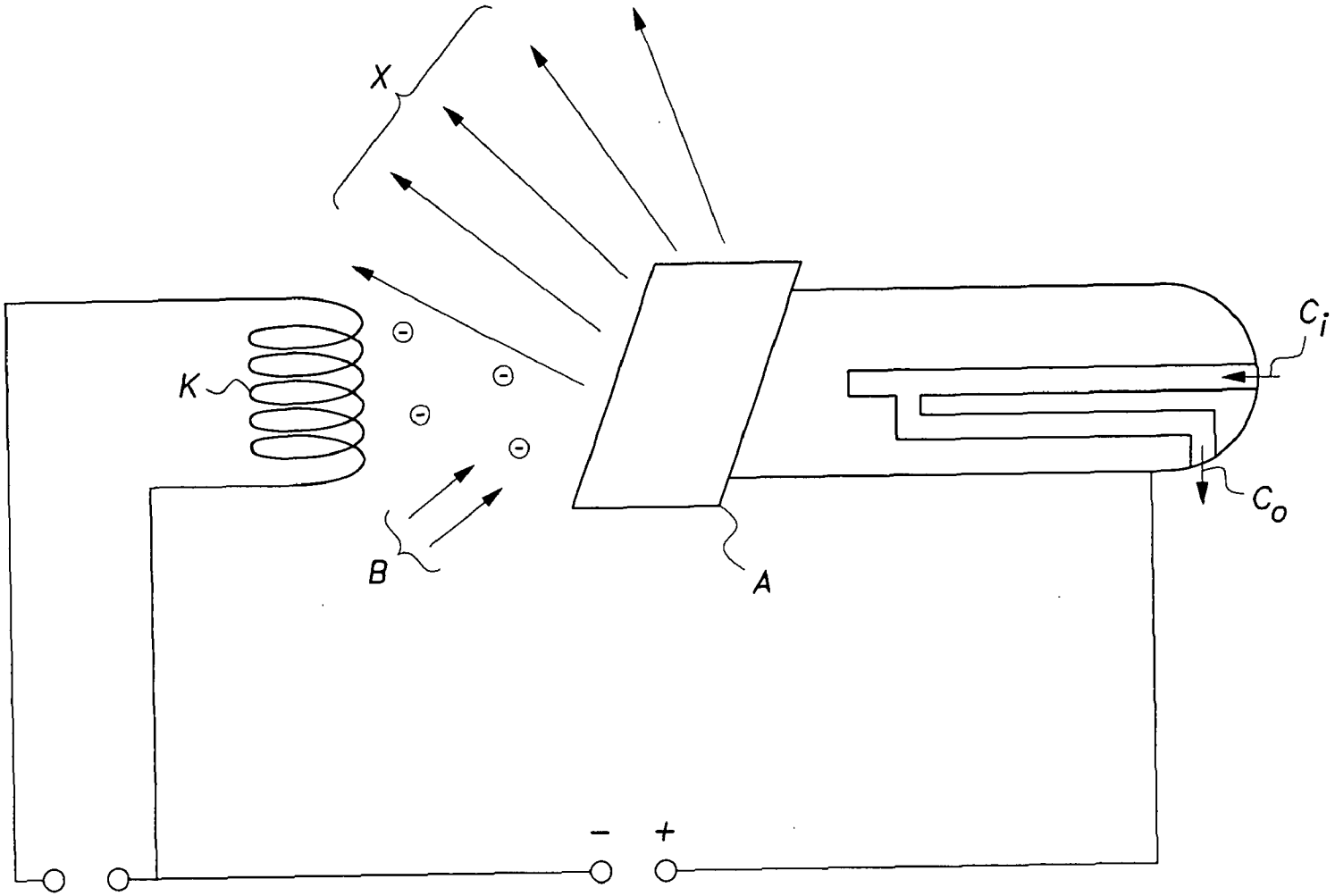
Ci
Co
A
X
B
K
+
-

X-RAY SYSTEM WITH SUPERCONDUCTING ANODE

BACKGROUND OF THE INVENTION

1. Field of the Invention

The present invention relates to radiological equipment, and more particularly to an x-ray system having a superconducting anode.

2. Description of the Related Art

The most common method to generate x-ray radiation is to bombard materials with energetic electrons. The process is not efficient, especially in diagnostic medical application of 20-120 keV, where radiative energy loss by electrons is about 1%. The rest of the electron's energy is dissipated in collisions with target electrons that is ultimately manifested as thermal energy. This thermal energy hinders critical imaging parameters of x-ray tubes, including total x-ray output, heat removal rate from surface, as well as bulk of the target size of the focal spot must be large enough to avoid damaging the anode surface (0.3 mm is in the low side for mammography). Duration of the X-ray pulse must be long to allow thermal dissipation of the input heat (50 milliseconds time is typical). Elevation of the brightness and/or increasing the e-beam current density will allow the following significant improvements.

Spectral manipulation techniques include selecting different energies and comparing their images to obtain new information or subtracting away certain tissues. Reducing the focal spot size allows for improving the image's resolution. Reducing the imaging time reduces motion blurring, for example, in cardiac (heart) imaging.

Thus, an x-ray system with a superconducting anode solving the aforementioned problems is desired.

SUMMARY OF THE INVENTION

The x-ray system with a superconducting anode includes an x-ray machine anode made from a material capable of superconductivity, which is then cooled to be in its superconducting state while being bombarded by an electron beam to generate x-rays. If a non-superconducting heat island is formed, then a magnetic field is used to penetrate this region and spread the heat in the form of hot electrons over the target material.

These and other features of the present invention will become readily apparent upon further review of the following specification and drawings.

BRIEF DESCRIPTION OF THE DRAWINGS

The sole FIGURE is a diagrammatic view of an x-ray system with a superconducting anode according to the present invention.

DETAILED DESCRIPTION OF THE PREFERRED EMBODIMENTS

As shown in the drawing, the x-ray system with a superconducting anode includes an X-ray machine anode A made of superconducting material, the anode A being cooled by circulating cryogenic heat transfer agent via paths $C_i$ and $C_o$ (if necessary) to be in its superconducting state while being bombarded by an electron beam generated by, for example, a cathode K to generate x-rays X. If a non-superconducting heat island is formed on the target A, then a magnetic field B is used to penetrate this region and spread the heat in the form of hot electrons over the target material.

The kinetic energy of electrons gained from the incoming e-beam finally shows up as kinetic energy of atoms (thermal energy). If the material of the anode A is in a superconducting state while being bombarded with electrons, this energy transformation is expected to be different. The electron-phonon interaction with atoms is expected to be less in a superconductor. The energetic primary electrons transfer their energy as excitations and ionizations to secondary electrons of the target. Those low energy secondary electrons are expected to travel with lower collisional stopping power (energy lost per unit distance). The collisional stopping power dominates by almost two orders of magnitude around 100 keV. The electron-nuclei interaction is expected to stay the same, keeping the radiative stopping power at the same level. The combined effects of decrease in collisional stopping power (dominant) and constancy of radiative stopping power improves x-ray output X in both effective energy and total output.

Cooper pairing in superconductors may reduce the apparent electron density. Reduced phonons lower the resistance to primary electrons in soft collisions. However, until the present invention there has been no direct investigation to this problem, making it interesting from a basic physics perspective as well as the application described herein. Temperature is known to cause spectral line broadening through mechanisms including Doppler effect and collisional de-excitation. This effect is not trivial in spectroscopic applications, but is quite insignificant in x-ray imaging.

It is to be understood that the present invention is not limited to the embodiment described above, but encompasses any and all embodiments within the scope of the following claims.

I claim:

1. An x-ray system with a superconducting anode, comprising:

an anode formed from superconducting material;

an electron beam generator bombarding the anode with an electron beam, thereby producing X-rays; and a magnetic field source directed at the anode to spread heat generated in non-superconducting islands of said anode.

2. The x-ray system with a superconducting anode according to claim 1, further comprising a cryogenic source maintaining said anode in a superconducting state.

* * * * *